United States Patent [19]

Towley, III

[11] Patent Number: 5,011,139

[45] Date of Patent: Apr. 30, 1991

[54] ASSISTED DIP/CHIN EXERCISE DEVICE

[75] Inventor: Carl K. Towley, III, Owatonna, Minn.

[73] Assignee: Lumex, Inc., Bay Shore, N.Y.

[21] Appl. No.: 491,000

[22] Filed: Mar. 9, 1990

[51] Int. Cl.[5] ..... A63B 21/062

[52] U.S. Cl. ..... 272/118; 272/63

[58] Field of Search ..... 272/62, 63, 65, 117, 272/118, 130, 134, 144

[56] References Cited

U.S. PATENT DOCUMENTS

| | | | |
|---|---|---|---|
| 3,592,465 | 7/1971 | Fulkerson . | |
| 3,707,285 | 12/1972 | Martin . | |
| 3,716,231 | 2/1973 | Martin . | |
| 3,734,495 | 5/1973 | Nist et al. | 272/118 |
| 3,746,338 | 7/1973 | Proctor | 272/118 |
| 4,111,414 | 9/1978 | Roberts . | |
| 4,471,956 | 9/1984 | Marlo . | |
| 4,624,457 | 11/1986 | Silberman et al. | 272/118 |
| 4,645,197 | 2/1987 | McFee | 272/65 |
| 4,765,610 | 8/1988 | Sidwell . | |
| 4,846,458 | 7/1989 | Potts . | |

OTHER PUBLICATIONS

King-Pro Freedom Spotter brochure from Sidwell Develpment, undated.

*Primary Examiner*—Robert Bahr
*Attorney, Agent, or Firm*—John W. Bunch

[57] ABSTRACT

An improved assisted dip/chin exercise device (10) comprises a frame (12), chin bar (28), dip bar (30) and a pivotal foot bar (54) which is connected through a cable and pulley system to a weight stack so that a pre-adjusted amount of assistance can be selectively applied when and as desired for more effective training.

18 Claims, 2 Drawing Sheets

ASSISTED DIP/CHIN EXERCISE DEVICE

TECHNICAL FIELD

The present invention relates generally to an apparatus for exercising and developing upper body strength. More particularly, this invention concerns an exercise device for doing either chin-ups or dips with selective, adjustable positive assistance.

BACKGROUND ART

Chin-ups and dips are exercises that develop upper body strength. However, these exercises are relatively difficult and require a certain amount of strength to do at all. The reason for this is that the person must support his/her entire body weight at all times while doing such exercises. People with very little upper body strength may not be able to do any chin-ups or dips, and even those people that do have sufficient upper body strength may only be able to do a few repetitions.

Various devices have been available heretofore for assisting people while doing such exercises; however, the assist devices of the prior art have tended to be overly complicated and/or difficult to use. For example, U.S. Pat. No. 4,846,458 to Potts shows an upper body exercise apparatus wherein the athlete or exerciser stands on a moveable platform that is connected to a pneumatic cylinder which is controlled so that the upward force assisting the exerciser is maintained constant during oscillation of the platform. U.S. Pat. No. 4,111,414 to Roberts shows a pullup assisting device incorporating a weight stack and harnass for cancelling at least a portion of the weight of the exerciser. U.S. Pat No. 3,592,465 to Fulkerson illustrates another device having a movable platform connected to a spring system for assisting the person performing chinning exercises.

A need has thus arisen for an improved assisted dip/chin device of straightforward construction which allows for pre-adjusted, selective assistance as desired while doing either chin-ups or dips.

SUMMARY OF THE INVENTION

The present invention comprises an improved assisted dip/chin device which overcomes the foregoing and other difficulties associated with the prior art. In accordance with the invention, there is provided an exercise device for doing either chin-ups or dips with selective, variable positive assistance. The device herein incorporates a fixed, raised platform from which the user can step into proper position for doing either chin-ups or dips, together with a pivotal assist or foot bar connected through a pulley and cable system to an adjustable weight stack. After the user is in proper position to do the desired exercise, he/she can then decide whether and when to push down against the assist or foot bar in order to achieve more effective training.

BRIEF DESCRIPTION OF DRAWINGS

A better understanding Of the invention can be had by reference to the following Detailed Description, in conjunction with the accompanying Drawings, wherein.

DETAILED DESCRIPTION

Figure 1:
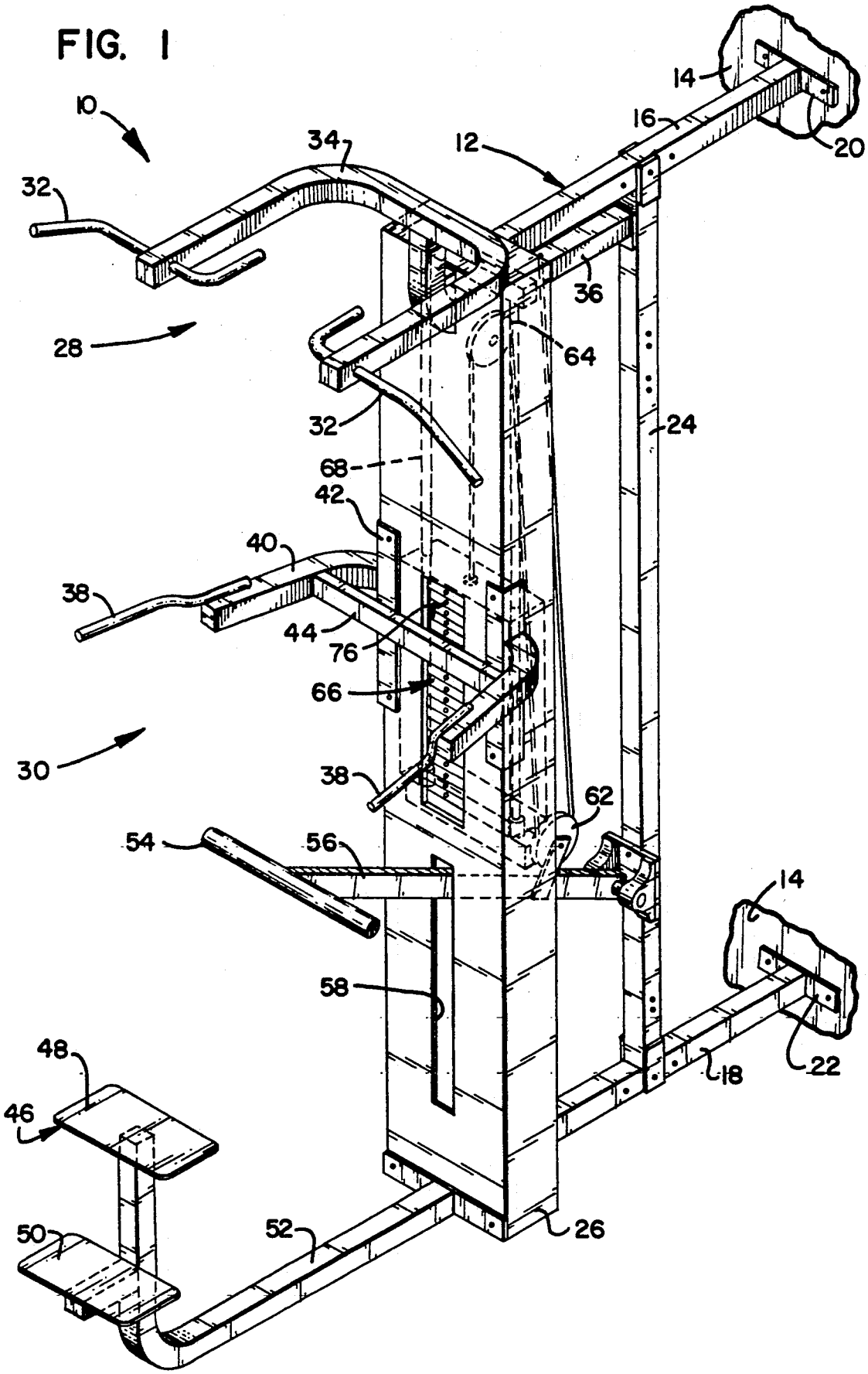
FIG. 1 is a perspective view of the assisted dip/chin exercise device of the invention.

Referring now to the Drawings, wherein like reference numerals designate like or corresponding elements throughout the views, there is shown the assisted dip/chin exercise device 10 of the invention. As will be explained more fully hereinafter, the exercise device 10 incorporates a pivotal foot bar connected to an adjustable weight stack in order to provide selective, positive assistance to the user while doing chin-ups or dips.

The exercise device 10 includes a frame 12 which can be either free standing or connected to a wall or part of a larger complex of exercise equipment. As illustrated, the frame 12 is connected to a wall 14. The frame 12 comprises upper and lower bars 16 and 18 extending outwardly from the wall 14. The upper bar 16 is secured at one end by a foot plate 20 and appropriate fasteners to the wall 14. Similarly, another foot plate 22 and appropriate fasteners are utilized to secure the lower bar 18 to the wall 14. A vertical bar 24 is secured between the upper and lower bars 16 and 18. In addition, a 3-sided shroud or enclosure 26 is secured between the upper and lower bars 16 and 18 in front of the vertical bar 24. The frame 12 is preferably constructed from sections of tubular stock.

Figure 2:
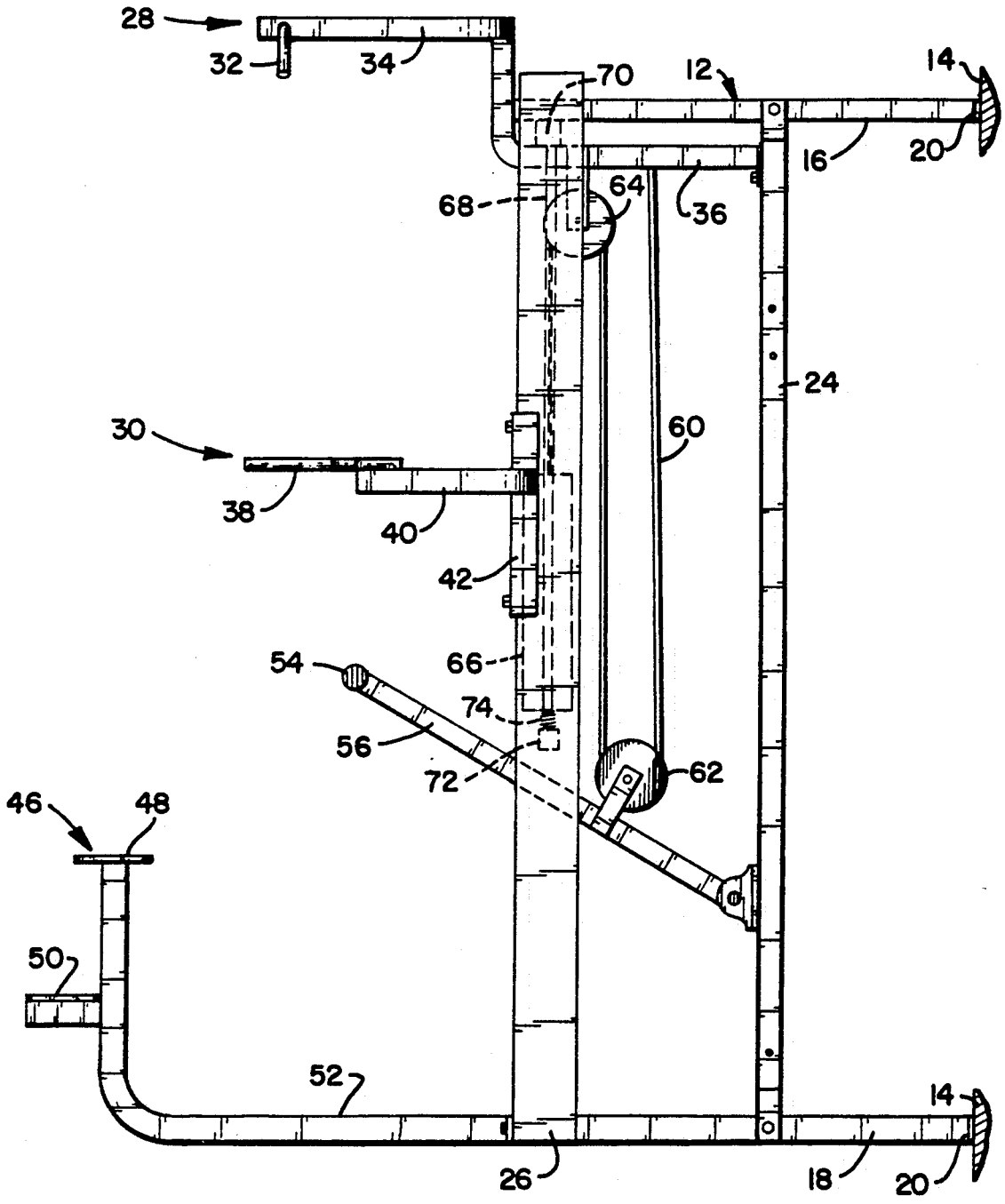
FIG. 2 is a side view thereof.

A chin bar 28 and a dip bar 30 are supported in a vertically spaced-apart relationship on the frame 12. In particular, the chin bar 28 includes a pair of handles 32 extending outwardly from opposite ends of a C-shaped member 34 which is secured to one end of an L-shaped member 36. The other end of the L-shaped member 36 is secured to the vertical member 24. The L-shaped member 36 thus extends outwardly from member 24 beneath and then upwardly across the front end of member 16, as is best seen in FIG. 2.

The dip bar 30 consists a pair of handles 38 secured to the outer ends of a pair of opposing arms 40, the inner ends of which are secured to brackets 42 mounted on opposite corners of the enclosure 26. A brace 44 is preferably connected between arms 40 for purposes of reinforcement.

The exercise device 10 also includes a fixed platform 46, which in the illustrated preferred embodiment includes two steps 48 and 50 secured to an extension 52 secured to the frame 12. The extension 52 can comprise a separate member attached to the frame 12, or an integral portion of the lower member 18.

The dip/chin exercise device 10 further includes a movable assist or foot bar 54 by which the person using the device can selectively apply a pre-adjusted positive force upwardly to assist him/her as desired in doing chin-ups or dips. The foot bar 54 is connected to one end of a pivotal arm 56 that extends outwardly through a slot 58 in the enclosure 26. The other end of the arm 56 is pivoted to the vertical frame member 24 as shown. The pivotal arm 56 is connected via cable 60 and pulleys 62 and 64 to a weight stack 66. One end of the cable 60 is secured to frame 12, while the other end is secured to the topmost weight of the weight stack 66. The pulley 62 is carried on the pivotal arm 56, while the pulley 64 is mounted on the frame 12. The weight stack 66 itself is of substantially conventional construction. The weight stack 66 is supported for vertical movement along a pair of guide rods 68 extending between upper and lower cross tubes 70 and 72. The upper cross tube 72 is secured between members 16 and 36. The lower cross tube 72 is secured between the inside walls of the enclosure 26. A spring 74 is preferably provided on each guide rod 68 between the cross tube 72 and the lowermost weight in the weight stack 66 for purposes of shock absorption. The weight stack 66 preferably consists of 20 plates of 12 pounds each, which provides variable assistance between about 12 and 120 pounds to the user depending upon the position of the removable pin 76.

From the foregoing, it will thus be appreciated that the present invention comprises an improved assisted dip/chin exercise device having several advantages over the prior art. One particular advantage is that the user can first select the desired amount of available positive assistance, and then selectively apply that assistance as desired by pushing down on the assist bar in order to train more effectively. Another advantage is that the device herein is user friendly because it can be used with little or no instruction. Other advantages will be evident to those skilled in the art.

Although particular embodiments of the invention have been illustrated in the accompanying Drawings and described in the foregoing Detailed Description, it will be understood that the invention is not limited only to the embodiments disclosed, but is intended to embrace any alternatives, equivalents, modifications and/or rearrangements of elements falling within the scope of the invention as defined by the following claims.

What is claimed is:

1. Exercise apparatus, which comprises:
a frame;
a chin bar mounted on said frame:
an assist bar positioned below said chin bar;
an arm pivoted at one end to said frame, said assist bar being secured to the other end of said arm for pivotal movement in an arcuate path toward and away from said chin bar; and
means including a pulley and cable system and selective weight stack connected between said arm and frame for normally urging said assist bar upwardly toward said chin bar.

2. The exercise apparatus of claim 1, wherein said frame includes:
an upper bar;
a lower bar; and
an upright bar connected between said upper and lower bars.

3. The exercise apparatus according to claim 2, further including:
means for connecting said upper and lower bars to a wall.

4. The exercise apparatus according to claim 2, further including:
a shroud enclosing at least part of said frame, said arm extending through a vertical opening therein.

5. The exercise apparatus of claim 1, further including:
an elevated step associated with said assist bar.

6. Exercise apparatus, which comprises:
a frame;
a chin bar mounted on said frame;
an assist bar positioned below said chin bar;
an arm pivoted at one end to said frame, said assist bar being secured to the other end of said arm for pivotal movement toward and away form said chin bar;
means connected between said arm and frame for normally urging said assist bar upwardly toward said chin bar;
said means for normally urging said assist bar upwardly including:
a first pulley rotatably mounted on said arm;
a second pulley rotatably mounted on said frame;
a plurality of weights arranged in a stack having an uppermost weight and a lowermost weight;
means mounted on said frame for supporting and guiding said weight between raised and lowered positions;
a length of cable extending about said first and second pulleys, one end of said cable being secured to said frame and the other end of said cable being secured to said uppermost weight, and
means for selectively connecting additional weight in the stack to said uppermost weight in accordance with the desired assistance.

7. The exercise apparatus according to claim 6, further including:
springs positioned between said lowermost weight and said supporting and guiding means.

8. The exercise apparatus of claim 6, further including:
an elevated step associated with said assist bar.

9. Exercise apparatus, which comprises:
a frame;
a dip bar mounted on said frame;
an assist bar positioned below said chin bar;
an arm pivoted at one end to said frame, said assist bar being secured to the other end of said arm for pivotal movement in an arcuate path toward and away from said dip bar; and
means including a pulley and cable system and selective weight stack connected between said arm and frame for normally urging said assist bar upwardly toward said dip bar.

10. The exercise apparatus of claim 9, wherein said frame includes:
an upper bar;
a lower bar; and
an upright bar connected between said upper and lower bars.

11. The exercise apparatus according to claim 10, further including:
means for connecting said upper and lower bars to a wall.

12. The exercise apparatus according to claim 10, further including:
a shroud enclosing at least part of said frame, said arm extending through a vertical opening therein.

13. The exercise apparatus of claim 9, further including:
an elevated step associated with said assist bar.

14. Exercise apparatus, which comprises:
a frame;
a dip bar mounted on said frame;
an assist bar positioned below said chin bar;
an arm pivoted at one end to said frame, said assist bar being secured to the other end of said arm for pivotal movement toward and away from said dip bar;
means connected between said arm and frame for normally urging said assist bar upwardly toward said dip bar;
wherein said means for normally urging said assist bar upwardly includes:
a first pulley rotatably mounted on said arm;
a second pulley rotatably mounted on said frame;
a plurality of weights arranged in a stack having an uppermost weight and lowermost weight;

means mounted on said frame for supporting and guiding said weight between raised and lowered positions;

a length of cable extending about said first and second pulleys, one end of said cable being secured to said frame and the other end of said cable being secured to said uppermost weight; and means for selectively connecting additional weight in the stack to said uppermost weight in accordance with the desired assistance.

15. The exercise apparatus according to claim 14, further including:

springs positioned between said lowermost weight and said supporting and guiding means.

16. The exercise apparatus of claim 14, further including:

an elevated step associated with said assist bar.

17. Assisted dip/chin exercise apparatus, comprising:

a frame;

a chin bar mounted on said frame;

a dip bar mounted on said frame below said chin bar;

an assist bar positioned below said dip bar;

an arm pivoted at one end to said frame, said assist bar being secured to the other end of said arm for pivotal movement in an arcuate path toward and away from said chin and dip bars;

a plurality of weights arranged in a stack having uppermost and lowermost weights;

means mounted on said frame for supporting and guiding said weights between raised and lowered positions;

means including a pulley and cable system interconnecting said frame, said arm and said uppermost weight; and means for selectively connecting additional weights in the stack to said uppermost weight in order to normally urge said assist bar upwardly in accordance with the desired assistance.

18. The exercise apparatus of claim 13, further including:

an elevated step associated with said assist bar.

* * * * *